US006225542B1

(12) United States Patent
Hall

(10) Patent No.: US 6,225,542 B1
(45) Date of Patent: May 1, 2001

(54) HANDDRUM BRACKET

(75) Inventor: Nathaniel Hall, Putney, VT (US)

(73) Assignee: Everyone's Drumming, Putney, VT (US)

( * ) Notice: Subject to any disclaimer, the term of this patent is extended or adjusted under 35 U.S.C. 154(b) by 0 days.

(21) Appl. No.: 09/497,112

(22) Filed: Feb. 3, 2000

Related U.S. Application Data

(60) Provisional application No. 60/130,647, filed on Apr. 23, 1999.

(51) Int. Cl.[7] ..... G10D 13/02

(52) U.S. Cl. ..... 84/421; 84/327; 248/230.8; 24/170

(58) Field of Search ..... 84/327, 329, 421; 224/163; 248/230.8, 218.4; 24/170, 191

(56) References Cited

U.S. PATENT DOCUMENTS

| | | | | |
|---|---|---|---|---|
| 4,881,303 | * | 11/1989 | Martini | 24/170 |
| 5,337,645 | * | 8/1994 | Johnston | 84/421 |
| 5,431,365 | * | 7/1995 | Hopkins | 248/683 |
| 5,572,771 | * | 11/1996 | Kelleghan | 24/170 |
| 5,632,461 | * | 5/1997 | Von Helms et al. | 248/218.4 |

* cited by examiner

*Primary Examiner*—Shih-Yung Hsieh
(74) *Attorney, Agent, or Firm*—Ostrolenk, Faber, Gerb & Soffen, LLP

(57) ABSTRACT

A handdrum bracket for securing a handdrum to a drum rack or stand. The bracket mechanism receives a webbing strap that is placed around a drum shell. The bracket tightens the strap tightly around the drum. A clamp disposed on the bracket allows the handdrum to be secured to the drum rack or stand. Accordingly, the handdrum can be incorporated into a drumkit without the need to pierce the drum shell.

6 Claims, 1 Drawing Sheet

HANDDRUM BRACKET

This application claims the benefit of U.S. Provisional Application Ser. No. 60/130.647, filed Apr. 23, 1999, the entire disclosure of which is incorporated herein by reference.

BACKGROUND OF THE INVENTION

1. Field of the Invention

The present invention relates to a handdrum bracket. More specifically, the present invention relates to a bracket for integrating handdrums into an existing drumkit without having to pierce the drum shell.

2. Brief Description of the Related Art

Drumkits provide various stands for supporting toms, snares, cymbals, etc. A drum to be supported on such a stand is provided with a bracket that is secured to the drum shell with screws or rivets that pierce the drum shell. Many drums, such as hand drums, for example, are not provided with such a bracket. Further, it may be impractical to secure a bracket to a handdrum or other percussion instrument for reasons of time, esthetics, or musical and structural integrity of the drum. Accordingly, the need exists in the prior art for an effective device and method for securing a handdrum to a drumkit stand.

SUMMARY OF THE INVENTION

The present invention overcomes the disadvantages of the prior art, such as those noted above, by providing a handdrum bracket that simply and securely attaches to the drum, allowing the drum to be supported on a drumkit stand.

The handdrum bracket includes a base that attaches to a flexible strap, such as a length of webbing. The webbing is looped through either end of the bracket and the assembly is placed around the drum shell. The bracket is then tightened to secure the webbing assembly to the drum. A clamp on the bracket is used to secure the drum to a drum rack.

Other features and advantages of the present invention will become apparent from the following description of the invention which refers to the accompanying drawings.

DETAILED DESCRIPTION OF THE PREFERRED EMBODIMENTS

Figure 1:
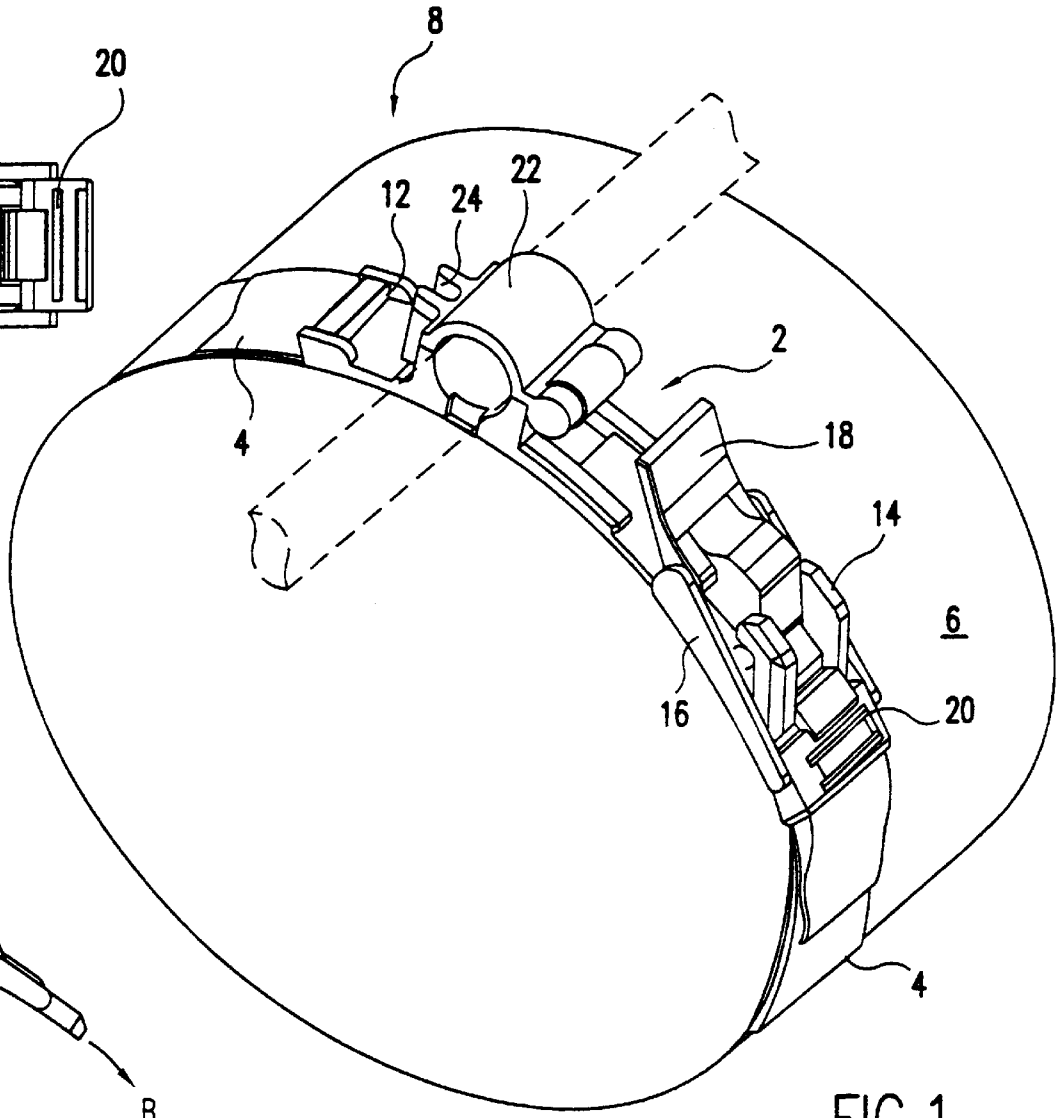
FIG. 1 is a perspective view illustrating a handdrum bracket according to the present invention secured to a handdrum, shown schematically.

Referring initially to FIG. 1, a bracket 2 according to the present invention is shown securing a strap 4 around a shell 6 of a drum 8. The bracket includes a base 10 having a slot 12 disposed on one end for receiving strap 4. A separate hinge section 14 is connected to the base 10 by an arm 16 and a lever 18. Hinge section 14 is provided with slot 20 for receiving the other end of the strap 4. A pivoting tube clamp 22 disposed on the base 10 is used to secure the bracket to a drum stand 24, indicated by dashed lines in FIG. 1.

The bracket preferably is made of injection molded plastic such as Delrin. Advantageously, the bracket is flexible and can bend into various circular shapes to accommodate various sizes of drums. The strap preferably is 1" webbing made of fabric, such as nylon.

Figure 2:
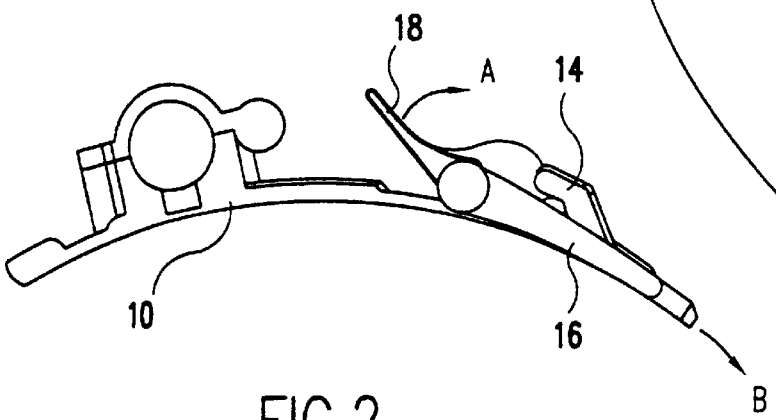
FIG. 2 is an elevation of a handdrum bracket according to the present invention.
Figure 3:
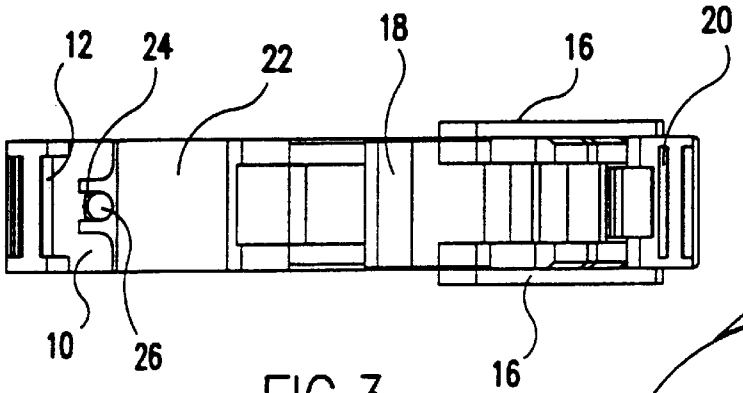
FIG. 3 is a plan view of the handdrum bracket of FIG. 2.

The bracket is secured to the drum as follows:

The bracket is opened by moving lever 18 in the direction of arrow A as shown in FIG. 2. Accordingly, arms 16 urge hinge section 14 in the direction of arrow B. Strap 4 is secured in slots 12 and 20 and placed around the drum shell 6. The strap is adjusted in the slots to provide an appropriate fit. The bracket is secured to the drum by moving the lever 18 in the direction opposite to arrow A in FIG. 2, thus closing the bracket and tightening the strap around the drum. The lever 18 moves into a locked position to maintain the strap tightly around the drum. The drum then is secured to a tom stand or drum rack using the clamp 22. Clamp 22 is secured tightly using a screw, for example, or other locking device, inserted through slot 24 and into threaded hole 26.

Although the present invention has been described in relation to particular embodiments thereof, many other variations and modifications and other uses will become apparent to those skilled in the art. For example, instead of circular clamp 22, a rectangular clamp, or a fixed bracket could be used. Therefore, the present invention is to be limited not by the specific disclosure herein, but only by the appended claims.

What is claimed is:

1. A bracket for securing a handdrum to a drum stand, the bracket comprising:

a base;

a hinge section;

a flexible strap secured at opposed ends to the base and the hinge section, respectively;

a clamp disposed on the base for securing the bracket to the drum stand; and a mechanism connecting between the base and the hinge section for adjusting a distance between the base and the hinge section for tightening the strap around the handdrum.

2. The bracket of claim 1, wherein the base and the hinge section include slots whereby the flexible strap is secured adjustably.

3. A bracket for securing a handdrum to a drum stand, the bracket comprising:

a base to which one end of a flexible strap is secured;

a hinge section to which the other end of the flexible strap is secured;

a lever hingedly connected between the hinge section and the base, wherein moving the lever causes the hinge section to move toward the base, such that the flexible strap, when disposed around an object, is tightened around the object.

4. The bracket of claim 3, further comprising a tube clamp disposed on the base.

5. The bracket of claim 1, wherein the mechanism for adjusting a length of the base for tightening the strap around the handdrum tightens the strap against a shell of the handdrum to secure the bracket to the handdrum without piercing the shell.

6. The bracket of claim 3, further comprising at least one arm connecting the hinge section to the base.

* * * * *